US005768708A

United States Patent [19]

Earp, IV

[11] Patent Number: 5,768,708

[45] Date of Patent: Jun. 23, 1998

[54] GARMENT WITH DISPLAY FEATURE

[76] Inventor: Wyatt Earp, IV, 2932 Rte. 96, Waterloo, N.Y. 13165

[21] Appl. No.: 791,938

[22] Filed: Jan. 31, 1997

[51] Int. Cl.[6] ..... A41B 1/00

[52] U.S. Cl. ..... 2/115; 2/69

[58] Field of Search ..... 2/69, 1, 115, 113, 2/106, 108, 200.2, 195.1, 243.1

[56] References Cited

U.S. PATENT DOCUMENTS 4,120,053 10/1978 Nemirofsky ..... 2/115
4,837,864 6/1989 Thill ..... 2/115
4,838,965 6/1989 Bussard ..... 2/115
4,847,916 7/1989 Winston ..... 2/115

*Primary Examiner*—Gloria Hale
*Attorney, Agent, or Firm*—Howard J. Greenwald

[57] ABSTRACT

A garment which contains about 50 weight percent of cotton and a strip of tire rubber is durably affixed to at least one part of the garment. The strip of tire rubber has a length of at least about 20 inches, a width of from about 8 to about 14 inches, and an aspect ratio of at least about 2.5/1.

12 Claims, 3 Drawing Sheets

FIG. 1
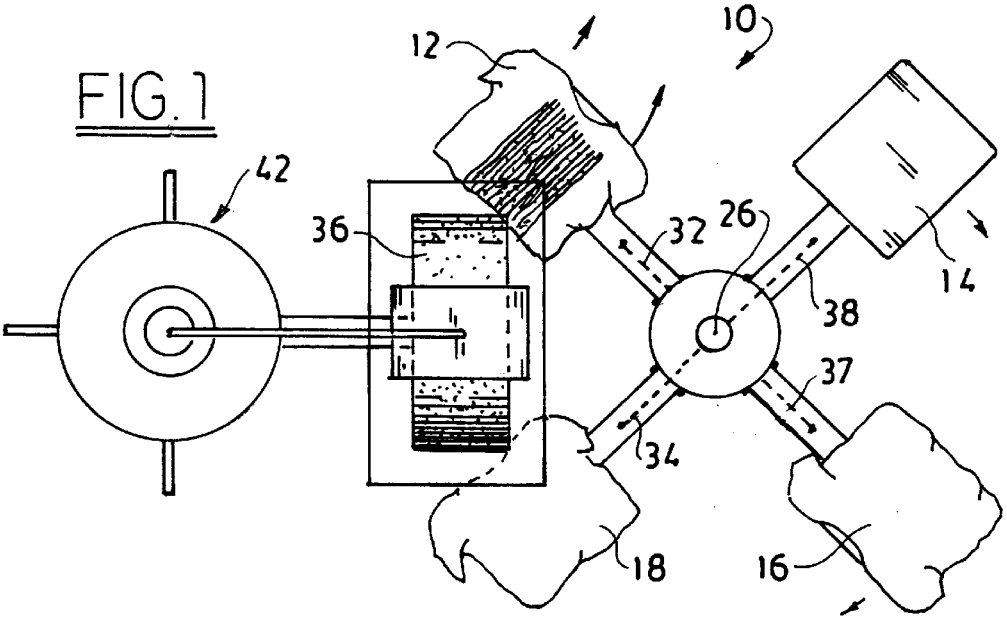
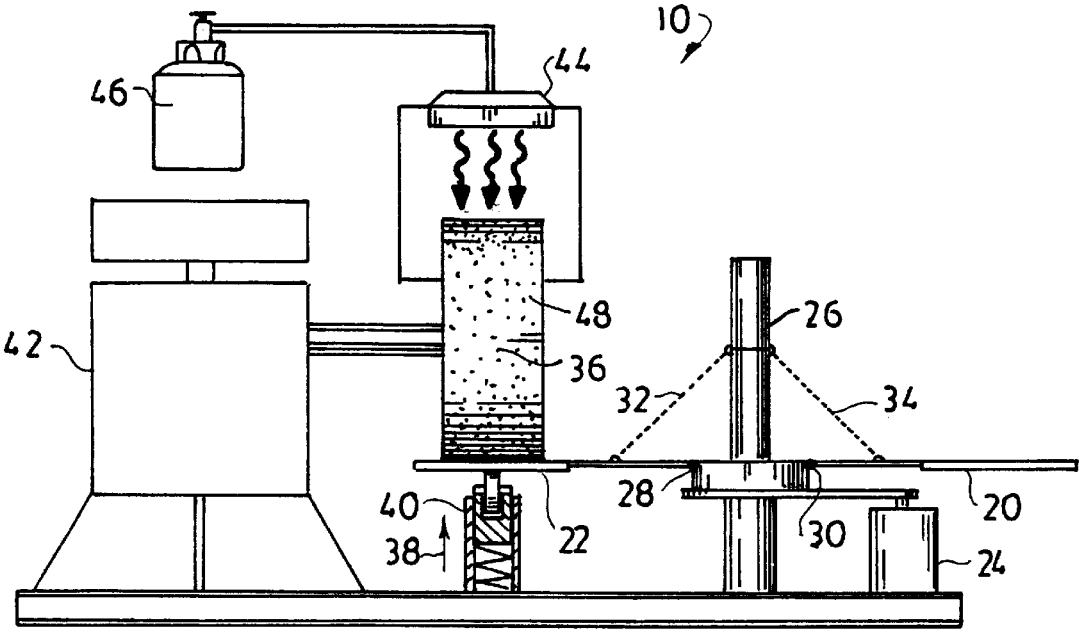
FIG. 2

GARMENT WITH DISPLAY FEATURE

FIELD OF THE INVENTION

A garment with a mark made on it by a tire from a racing vehicle.

BACKGROUND OF THE INVENTION

Garments with display features are known to those in the art. U.S. Pat. No. 5,481,758 discloses a garment which carries a message ("I have the money, honey, if you have the time.") together with a three-dimensional display (a three-dimensional display of paper money). U.S. Pat. No. 5,175,888 discloses an outerwear garment with a display panel. U.S. Pat. No. 5,005,218 discloses a garment whose body has an aperture which coacts with another part of the garment to produce a three-dimensional display.

Motorsports racing is a very popular sport, both in the United States and the rest of the world. To the best of applicant's knowledge, the prior art has not disclosed or provided any garment which has affixed to it a souvenir of a race car driver's vehicle.

It is an object of this invention to provide a garment which is integrally bonded to a portion of a race car driver's vehicle's tire.

It is another object of this invention to provide a process for making such garment.

SUMMARY OF THE INVENTION

In accordance with this invention, there is provided a garment which is integrally bonded with a layer of rubber on one of its surfaces.

BRIEF DESCRIPTION OF THE DRAWINGS

The present invention will be more fully understood by reference to the following detailed description thereof, when read in conjunction with the attached drawings, wherein like reference numerals refer to like elements, and wherein:

FIG. 1 is a top view of one apparatus for making the garment of this invention.

FIG. 2 is a side view of the apparatus of FIG. 1.

DESCRIPTION OF THE PREFERRED EMBODIMENTS

Figure 3:
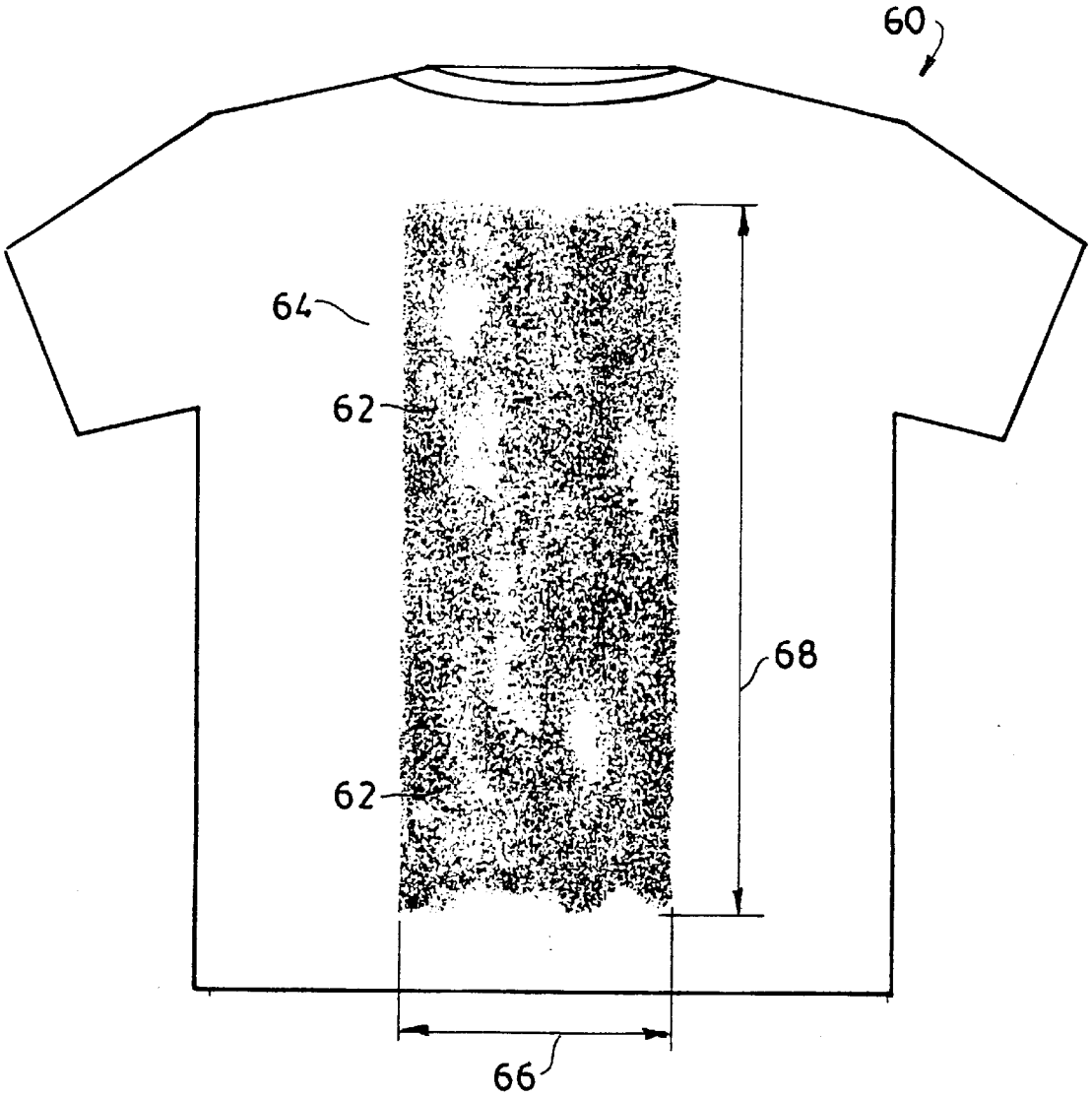
FIG. 3 is a back view of one embodiment of the garment made by the apparatus of FIG. 1.

FIG. 1 is a top view of one preferred machine 10 for making the garment of this invention.

Referring to FIG. 1, it will be seen that a garment, such as garments 12, 14, 16, and 18, may be used in conjunction with machine 10.

As used herein, the term garment includes articles of dress and clothing. Thus, by way of illustration and not limitation, it includes outerwear garments, such as hats, tee shirts, sweat shirts, and the like.

It is preferred that the garment used in the process cotton at least 50 weight percent of cotton and, more preferably, at least about 80 weight percent of cotton. In one embodiment, the garment consists essentially of cotton.

Referring again to FIG. 1, and also to FIG. 2, it will be noted that garments 12, 14, 16, and 18 are mounted upon rotatable paddles, such as paddles 20 and 22, which are caused to rotate by motor 24. These paddles 20 and 22 are connected to a rotatable shaft 26. Paddles 20 and 22 are mounted on pin bushings 28 and 30, which are maintained in position by chains 32, 34, 36, and 38. The chains 32 et seq. in turn are connected to shaft 26.

The flexible nature of chains 32 et seq. allows paddles 20 and 22 (and the other paddles used in the device) to be movable in and upwardly and downwardly arcuate direction.

In the operation of device 10, a paddle (such as paddle 22) is disposed beneath a tire 36. Because of the forces of gravity, it will tend to be in the extreme downward position allowed by chain 32 (see FIG. 2).

Thereafter, paddle 22 (and its associated garment, not shown) is urged upwardly in the direction of arrow 38 by spring loaded roller 40, thereby making contact with a hot, rotating tire 36.

After a sufficient amount of such contact has been made, the paddle 22 is rotated out of contact with tire 36 while the next paddle 20 is rotated into such contact. As will be apparent to those skilled in the art, as soon as paddle 22 is now longer being urged upwardly by spring loaded roller 40, gravity will force it downwardly to the full extent permitted by chain 32.

The tire 36 will be chosen from the tires which have been used by one or more race car drivers on a racing vehicle. The purchaser of the garment made by the apparatus of FIGS. 1 and 2 will have a unique and authentic impression of such tire on this garment.

The tire 36 preferably will contain natural or synthetic rubber, often referred to as "tire rubber." This tire rubber is well known to those skilled in the art and is referred to in U.S. Pat. Nos. 5,397,818, 5,387,565, 5,380,506, 5,299,744, 5,288,674, 5,264,640, 5,176,957, 5,176,767, 5,550,135, 4,257,925, and the like. The disclosure of each of these United States patents is hereby incorporated by reference into this specification.

As is known to those skilled in the art, rubber is any of a number of natural or synthetic high polymers having unique properties of deformation (elongation or yield under stress) and elastic recovery after vulcanization with sulfur or other crosslinking agent, which in effect changes the polymer from thermoplastic to thermosetting. The yield or stretch of the vulcanized material ranges from a few hundred to over 1,000 percent. The deformation after break, called "permanent set," is usually taken as the index of recovery; it ranges from 5–10% for natural rubber to 50% or more for some synthetic elastomers. See, e.g., pages 688–700 of Volume 11 of the "McGraw Hill Encyclopedia of Science & Technology" (McGraw-Hall Book Company, New York, 1977).

Referring again to FIGS. 1 and 2, tire 36 is caused to rotate by means of a tire spinning machine 42 which rotates tire 36 in the Y axis.

Any conventional machine can be used to rotate tire 36. Thus, by way of illustration and not limitation, one may rotate tire 36 either clockwise or counterclockwise by means of the tire spinning devices commonly found in tire balancing machines. Reference may be had to U.S. Pat. Nos. 5,396,436, 5,303,463, 4,655,080, 4,269,451, 4,229,977, 3,995,498, 3,913,980, 3,875,804, and the like. The disclosure of each of these United States patents is hereby incorporated by reference into this specification.

In one embodiment, it is preferred to rotate tire 36 at a rate of from about 150 to about 700 revolutions per minute and, more preferably, from about 200 to about 400 revolutions per minute. One may control the rate of rotation by means of a rheostat or similar control means (not shown) (operatively connected to an electric motor (not shown).

Referring again to FIG. 2, as tire 36 is rotating, it preferably is also being heated by radiant heater 44 which, in the embodiment depicted in FIG. 2, is fed natural gas from propane tank 46.

It is preferred that radiant heater 44 be a gas-fired infrared heater such as, e.g., one or more of the infrared heaters disclosed in U.S. Pat. Nos. 5,441,075, 5,439,406, 5,417,389, 5,278,939, 5,176,755, 5,060,288, 4,702,693, 3,489,134, and the like. The disclosure of each of these United States patents is hereby incorporated by reference into this specification.

It is preferred to choose a heater 44 and a distance of such heater from tire 36 so that, during operation, the surface 48 of tire 36 is at a temperature of from about 200 to about 500 degrees Fahrenheit and, more preferably, from about 200 to about 450 degrees Fahrenheit.

During the operation of device 10, it is preferred that rotating tire 48 contact the garment to be treated for a period of less than about 20 seconds and, more preferably, less than about 10 seconds. In one embodiment, tire 36 contacts each of garments 12, 14, 16, and 18 for from about 2 seconds to about 10 seconds.

FIG. 3 is back view of garment 60 which, in the embodiment depicted, is a tee shirt made of 100 percent cotton. Because of the unique nature of applicant's process, the particles 62 of tire rubber are believed to be actually embedded within the cotton fibers of tee shirt.

Referring to FIG. 3, and in the preferred embodiment depicted therein, it will be seen that a strip 64, or rubber marking, of the tire rubber material is durably deposited on garment 60. By durably deposited is meant that the garment so depicted can be washed at least two times in cold water in a conventional washing machine and drip dried and still retains the adhesion of the rubber strip 64 to the garment. There is no noticeable fading of the rubber strip 64 after such two washings.

Referring again to FIG. 3, and in the preferred embodiment depicted therein, it will be seen that strip 64 has a width of from about 8 to about 14 inches, a length 68 of at least about 20 inches (and preferably from about 20 to about 30 inches), and an aspect ratio (the ratio of its length to its width of at least about 2.3/1 and preferably at least about 3/1.

The tire rubber strip 64 generally has a substantially black appearance.

Figure 4:
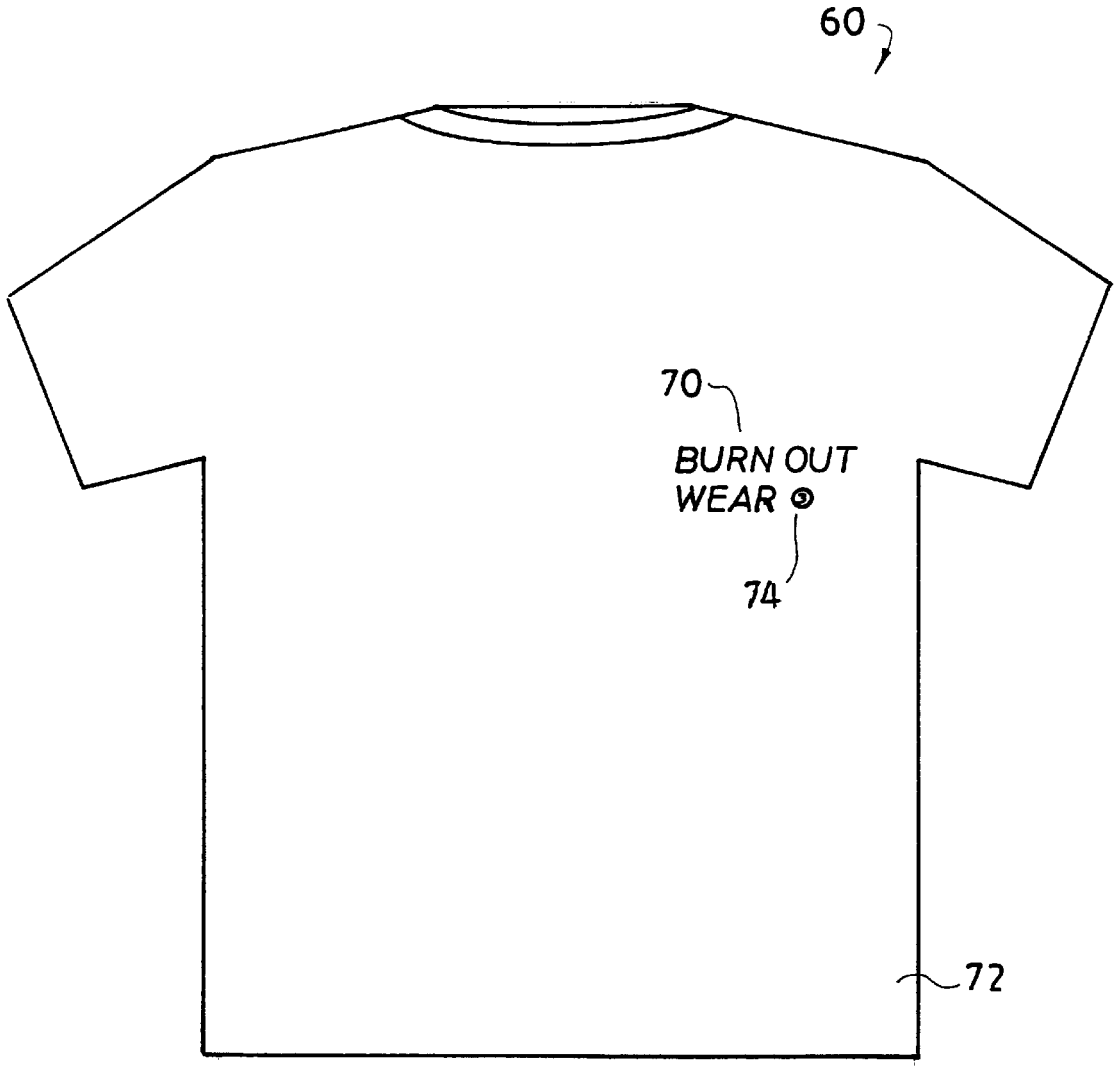
FIG. 4 is a front view of the garment of FIG. 3.

FIG. 4 is a front view of the garment 60 of FIG. 3 illustrating, in the preferred embodiment depicted, a "logo" 70 embroidered or printed on the front side 72 of the garment. In the embodiment depicted, the logo of "BURN OUT WEAR" together with number 74 indicates that the garment has burnt out tire marking on its back from the racing team number indicated in number 74. As will be apparent to those skilled in the art, other symbols, words, and/or messages can be used in place of and/or in addition to the message depicted.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A garment comprised of an article of clothing, wherein said article of clothing comprises at least about 50 weight percent of cotton, wherein a strip of tire rubber is durably affixed to at least one surface of said article of clothing, and wherein said strip of tire rubber has a length of at least about 20 inches, a width of from about 8 to about 14 inches, and an aspect ratio of at least about 2.5/1.

2. The garment as recited in claim 1, wherein said article of clothing contains at least about 80 weight percent of cotton.

3. The garment as recited in claim 1, wherein said article of clothing consists essentially of cotton.

4. The garment as recited in claim 1, wherein said aspect ratio is at least about 3.1/1.

5. The garment as recited in claim 1, wherein said article of clothing is a tee shirt.

6. The garment as recited in claim 1, wherein said article of clothing is a sweat shirt.

7. A process for making a garment, comprising the steps of:

(a) rotating a tire at a speed of from about 150 to about 700 revolutions per minute while heating the tread of said tire to a temperature of from about 200 to about 500 degrees Fahrenheit, thereby producing a heated, rotating tire;

(b) contacting said heated, rotating tire with a garment comprised of at least about 50 weight percent of cotton.

8. The process as recited in claim 7, wherein said tire is rotated at a speed of from about 200 to about 400 revolutions per minute.

9. The process as recited in claim 8, wherein said heated tire is contacted with said garment for less than 20 seconds.

10. The process as recited in claim 9, wherein said tire is heated to a temperature of from about 200 to about 450 degrees Fahrenheit.

11. The process as recited in claim 10, wherein said heated tire is contacted with said garment for less than about 10 seconds.

12. The process as recited in claim 11, wherein said heated tire is contacted with said garment for from about 2 to about 10 seconds.

* * * * *